US007210487B2

(12) United States Patent
Carsh et al.

(10) Patent No.: US 7,210,487 B2
(45) Date of Patent: May 1, 2007

(54) THREE DIMENSIONAL NAIL STENCILS AND METHOD OF USE

(76) Inventors: Charlotte E. Carsh, 300 E. 17th Ave. #1419, Denver, CO (US) 80203; Kim N. Le, 2812 S. Walden Way, Aurora, CO (US) 80013

( * ) Notice: Subject to any disclaimer, the term of this patent is extended or adjusted under 35 U.S.C. 154(b) by 436 days.

(21) Appl. No.: 10/672,729

(22) Filed: Sep. 26, 2003

(65) Prior Publication Data

US 2005/0066992 A1 Mar. 31, 2005

(51) Int. Cl.
*A45D 29/00* (2006.01)

(52) U.S. Cl. ..... 132/200; 132/73

(58) Field of Classification Search ..... 132/285, 132/319; 434/87; 249/104; 101/127, 128, 101/128.1, 128.21
See application file for complete search history.

(56) References Cited

U.S. PATENT DOCUMENTS 1,560,407 A * 11/1925 Carufel ..... 101/127
2,227,325 A * 12/1940 Shapiro ..... 101/128.1
2,234,657 A * 3/1941 Smaldone ..... 132/285
2,851,805 A * 9/1958 Allen ..... 132/319
2,952,225 A * 9/1960 Ellison ..... 101/4
3,119,188 A * 1/1964 Orndorff ..... 33/565
3,461,885 A * 8/1969 Coveney ..... 132/285
3,925,586 A * 12/1975 Maxwell ..... 428/195.1
4,135,020 A * 1/1979 Maxwell ..... 428/131
4,309,825 A * 1/1982 Geddes ..... 33/564
4,563,154 A * 1/1986 Vandervort et al. ..... 434/87
4,577,648 A 3/1986 Dinerstein
5,054,391 A * 10/1991 Tanaka et al. ..... 101/127.1
5,105,551 A * 4/1992 McCutchen et al. ..... 335/63
5,316,026 A 5/1994 Jenkins
5,427,121 A 6/1995 Polito
5,577,521 A 11/1996 Neitlich
5,658,184 A 8/1997 Hoopman
5,782,249 A 7/1998 Weber
5,817,143 A * 10/1998 Perry ..... 607/88
5,873,375 A 2/1999 Johnson
5,890,495 A 4/1999 Cain
6,067,996 A 5/2000 Weber
6,206,009 B1 3/2001 Paxson
6,213,131 B1 4/2001 Vien
6,286,517 B1 9/2001 Weber
6,349,640 B1 * 2/2002 Takebe et al. ..... 101/127
2004/0221754 A1 * 11/2004 Cochran et al. ..... 101/127.1

* cited by examiner

*Primary Examiner*—Todd E. Manahan
(74) *Attorney, Agent, or Firm*—Macheledt Bales & Heidmiller, LLP; Jennifer L. Bales

(57) ABSTRACT

A three dimensional stencil for use in applying raised acrylic designs to nails comprises a generally flat, flexible portion adapted for contact with a portion of a fingernail or toenail, and a cut-out portion formed within the confines of the flexible portion. The cut-out portion includes walls having a thickness of at least about 3 mm. The flexible portion forms an opening adjacent to the cut-out portion. In one embodiment, the flexible portion is itself of a thickness of at least about 3 mm, and the cut-out portion forms an opening in the flexible portion. In another embodiment, the cut-out portion comprises walls attached to and extending up from the flexible portion. In the second embodiment, tabs connecting the cut-out portion walls to the flexible portion may be used.

14 Claims, 3 Drawing Sheets

THREE DIMENSIONAL NAIL STENCILS AND METHOD OF USE

BACKGROUND OF THE INVENTION

1. Field of the Invention

The present invention is related to three dimensional nail stencils and their use.

2. Description of the Related Art

FIG. 1 (Prior Art) shows a conventional nail stencil 100 used for decorating fingernails and toenails. See, for example, U.S. Pat. No. 5,873,375 to Johnson, et al. Stencil 100 has one or more cut-outs 102. Stencils are often made of paper or a thin, flexible plastic (on the order of 0.1 mm thickness or less). In use, stencil 100 is placed on a fingernail 104 with a selected cut-out 102 positioned at a chosen spot on nail 1–4. Stencil 100 is held in place as fingernail polish is painted over a cutout 102. When stencil 100 is removed, a design in the shape of the chosen cut-out 102 is left on fingernail 104.

Acrylic for use in decorating nails is also known in the art. Colored acrylic has recently become available. It is known to apply three dimensional decorations, such as rhinestones, to fingernails.

A need remains in the art for three dimensional stencils for use in applying acrylic to nails to form three dimensional designs.

SUMMARY OF THE INVENTION

The present invention is a three dimensional stencil for use in applying white or colored acrylic to nails to form three dimensional designs and comprises a generally flat, flexible portion adapted for contact with a portion of a fingernail or toenail, and a cut-out portion formed within the confines of the flexible portion. The cut-out portion includes walls having a thickness of at least about 1 mm. Up to 3 mm thickness or more may be used for deeper patterns. The flexible portion forms an opening adjacent to the cut-out portion.

In one embodiment, the flexible portion is itself of a thickness of at least about 1 mm, and the cut-out portion forms an opening in the flexible portion. In another embodiment, the cut-out portion comprises walls attached to and extending up from the flexible portion. In the second embodiment, tabs connecting the cut-out portion walls to the flexible portion may be used.

As a feature, the flexible portion may be generally nail-shaped, and may further include a sticky layer for sticking the flexible portion to the nail. The flexible portion may include more than one cut-out portion, and the flexible portion may comprise a sheet larger than a nail.

A method of applying a three dimensional acrylic design to a fingernail or toenail with-the three dimensional stencil of the present invention includes the steps of applying the flexible stencil having a cut-out with walls of at least about 1 mm thickness to a nail, applying acrylic into the cutout to form a 3-d acrylic design, and removing the stencil. To improve bonding, the method may also include the steps of roughening the nail and/or applying primer prior to applying the stencil. The design may be painted if desired. The process may be repeated to create multilevel designs.

BRIEF DESCRIPTION OF THE DRAWINGS

FIG. 1(*b*) shows a side view of the stencil of FIG. 1(*a*).

FIG. 2(*b*) is a front view of the stencil of FIG. 2(*a*). FIG. 2(*c*) is a front view of the stencil of FIG. 2(*a*) with its backing removed. FIG. 2(*d*) shows the three dimensional stencil of FIG. 1(*a*) in use on a nail.

FIG. 3(*b*) is a front view of the stencil of FIG. 3(*a*). FIG. 3*c*) is an isometric view of the three dimensional portion of the stencil of FIG. 3(*a*).

FIG. 4(*d*) shows a top view of a design applied using the stencils of FIGS. 4(*a*), 4(*b*) and 4(*c*). FIG. 4(*e*) is a front view of the design of FIG. 4(*d*).

FIG. 5(*b*) is a side view of the stencil of FIG. 5(*a*).

DETAILED DESCRIPTION OF THE PREFERRED EMBODIMENTS

Figure 1:
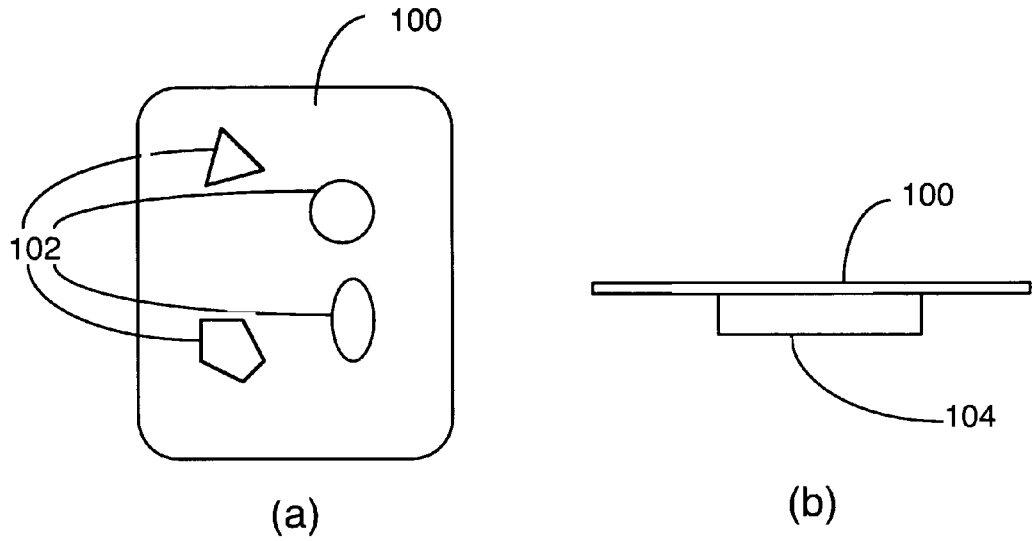
Figure 1 (Prior Art)
FIG. 1(*a*) (Prior Art) shows a conventional two dimensional stencil for use in applying fingernail polish designs to nails.
Figure 2:
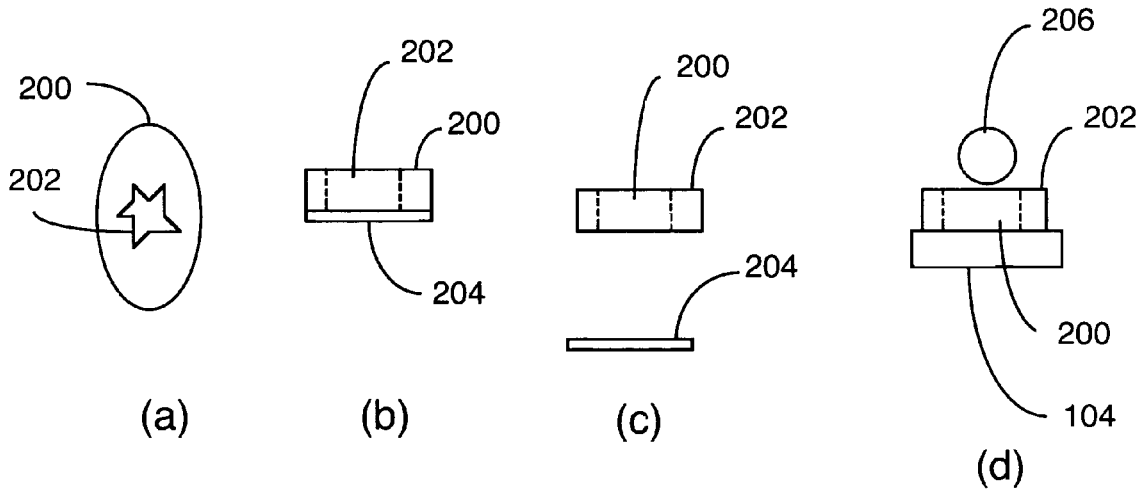
FIG. 2(*a*) is a top view of a first embodiment of a three dimensional stencil according to the present invention.
Figure 6:
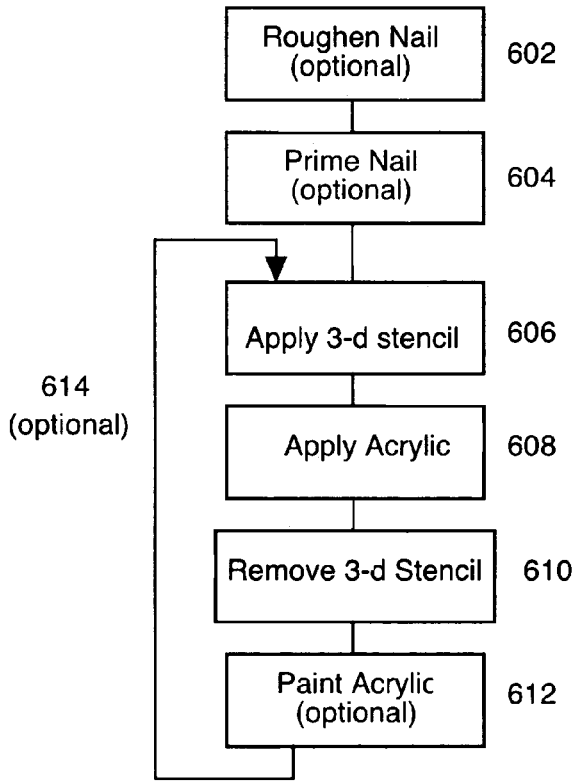
FIG. 6 is a flow diagram illustrating the steps used in applying a three dimensional design with a three dimensional stencil according to the present invention.

FIGS. 2(*a*) through 5(*b*) illustrate several preferred embodiments of the present invention, comprising three dimensional (3-d) stencils used to apply three dimensional acrylic design to fingernails and toenails. FIG. 6 illustrates the steps followed using these stencil to create 3-d designs.

FIG. 2(*a*) is a top view of a first embodiment of a three dimensional stencil 200. Stencil 200 is formed of a thick, flexible material, such a neoprene, and has one or more cut-outs 202 which provide a template for the acrylic design to be applied. In the embodiment of FIG. 2, Stencil 200 is generally nail-shaped and preferably has a sticky surface 208 for adhesion to a nail. Note that stencil 200 may be formed of a number of different materials, including paper, plastic, metal such as aluminum, or fabric.

FIG. 2(*b*) is a front view of stencil 200. As shown, stencil 200 has considerable thickness, on the order of 1 mm or more. Stencils will generally be from about 1 mm to 3 mm thick. It may include a removable backing 204 covering its sticky surface 208. The dotted lines indicate cut-out 202. FIG. 2(*c*) is a front view of stencil 200 with its backing 204 removed. Once backing 204 is removed, stencil 200 can be applied to a fingernail. Sticky surface 208 holds stencil 200 in place with the design is applied. Cut-out 202 is now open to the nail.

FIG. 2(*d*) shows three dimensional stencil 200 in use on a nail. Sticky surface 208 adheres to fingernail 104. Acrylic 206 is poured or otherwise applied into cut-out 202. Once acrylic 206 has partially or fully dried, stencil 200 is removed, leaving the 3-d design on the nail.

Acrylic comes in liquid and powdered form. The liquid form may be poured into 20 the stencil. Another method of application is, to dip a brush or other implement into liquid acrylic, and then into powder to form a wet ball. This ball may be applied to the stencil cut-out.

Figure 3:
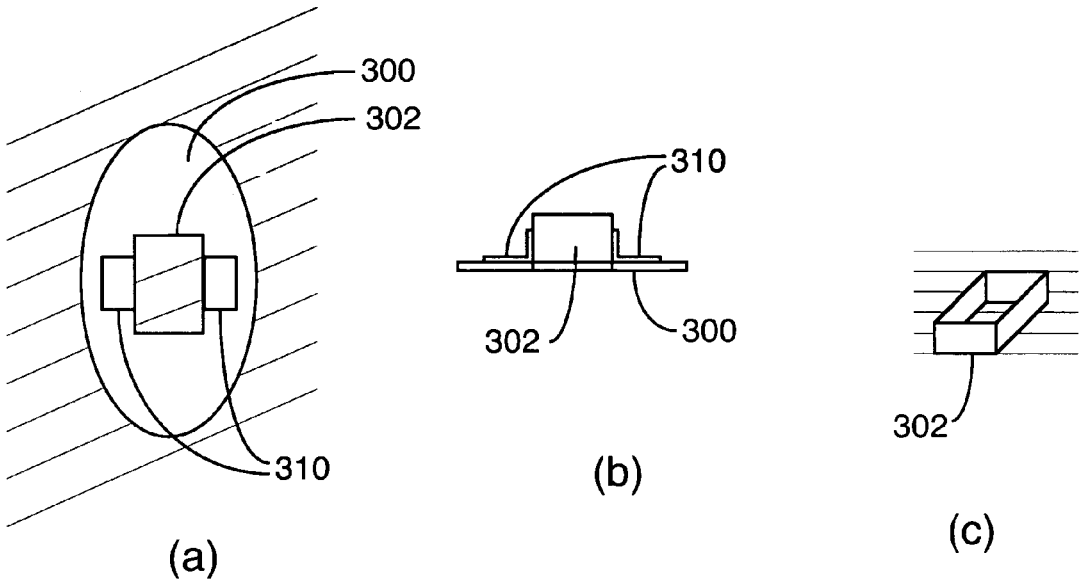
FIG. 3(*a*) is a top view of a second embodiment of a three dimensional stencil according to the present invention.

FIG. 3(*a*) is a top view of a second embodiment 300 of a three dimensional stencil, illustrating the raised cut-out type of 3-d stencil. Stencil 300 is also generally nail shaped, and may include a sticky surface 208. However, stencil 300 includes a flexible flat portion 304 and a 3-d cut-out portion 302 attached to flat portion 304, preferably with tabs 310. Tabs 310 may be spaced apart, as shown in FIG. 3(*a*), or may extend around the entire periphery of cut-out 302. Tabs 310 are not absolutely required, as cut-out portion 302 may be attached to stencil 300 along its edge, but tabs 310 improve the stability of the design. Note that flat portion 304 is open within the periphery of 3-d cut-out portion 302.

FIG. 3(*b*) is a front view of stencil 300, showing raised cut-out 302 attached to flat portion 300 with tabs 310. FIG. 3(*c*) is an isometric view of the three dimensional raised cut-out 302 of stencil 300. In use, acrylic 206 is poured into 3-d raised cut-out 302, which is open at the bottom to nail 104. Once acrylic 206 hardens to the extent desired, stencil 300 is removed.

Figure 4:
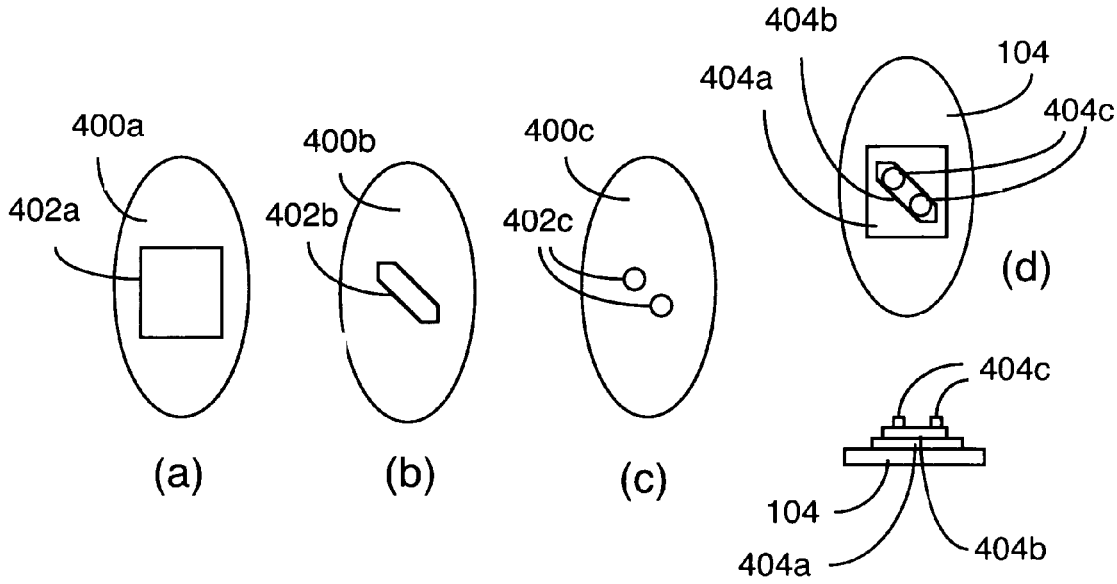
FIGS. 4(*a*), 4(*b*) and 4(*c*) are a top views illustrating a third embodiment of a three dimensional stencil according to the present invention.

FIGS. 4(*a*), 4(*b*) and 4(*c*) are a top views illustrating a third embodiment of a three dimensional stencil according to the present invention. FIGS. 4(*a*) through 4(*e*) illustrate how successive layers of 3-d acrylic may be applied to form a multilevel design. 3-d stencil 400*a* includes cut-out 402*a*, 3-d stencil 400*b* includes cut-out 402*b*, and stencil 400*c* includes cutouts 402*c*. Stencils 400*a–c*are applied in sequence, and acrylic 206 is poured or otherwise applied into cutouts 402*a–c* in turn. Acrylic 206 may be painted after each step, or different colors of acrylic (including white) may be used. The 3-d stencil may be of the thick-layer type shown in FIG. 2*a–d*, or the raised cut-out type shown in FIG. 3*a–c*, or a combination of the two.

FIG. 4(*d*) shows a top view of a design applied using stencils 400*a–c*. Nail 104 now includes a bottom-most design 404*a*, a middle design 404*b*, and a top-most design 404*c*. FIG. 4(*e*) is a front view of the design of FIG. 4(*d*), showing the depths of the design layers. Generally, each design 404 will be of a different color for contrast. Note that while raised designs 404 are shown with sharp edges, in fact the acrylic beads slightly, so the edges Will be somewhat rounded, especially if each stencil is removed before the acrylic fully dries.

Figure 5:
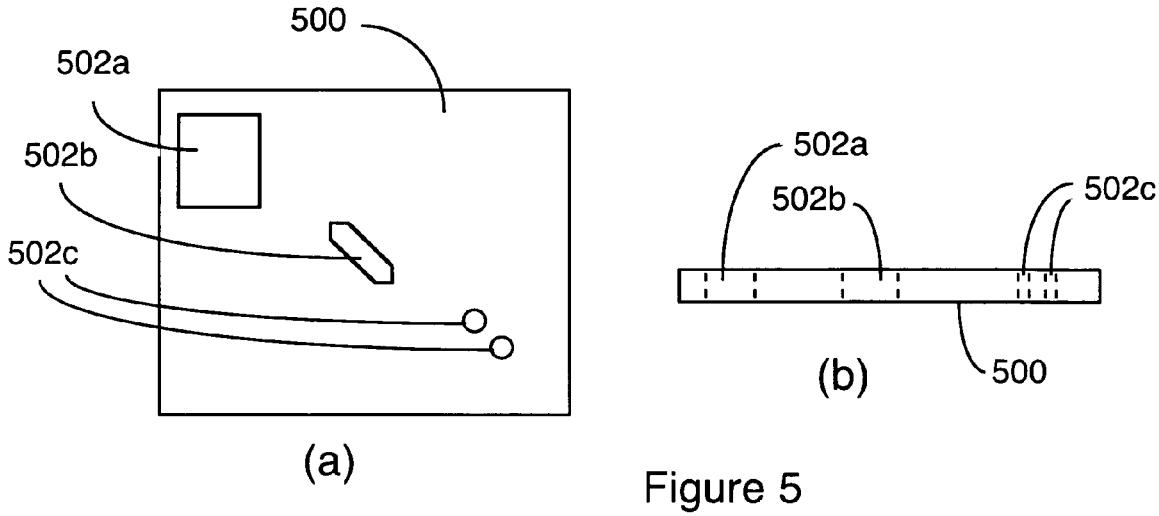
FIG. 5(*a*) is a top view of a fourth embodiment of a three dimensional stencil according to the present invention.

FIG. 5(*a*) is a top view of a fourth embodiment of a three dimensional stencil 500 according to the present invention. Stencil 500 may be of the thick-layer form shown in FIGS. 2(*a*)–(*d*) or in the raised cut-out form shown in FIGS. 3(*a*)–(*c*). Stencil 500 may be stuck to nail 104 with a sticky bottom layer, or may simply be held in place.

In use, stencil 500 is applied to nail 104 three times, locating designs 502*a–c* as desired on nail 104, and applying layers of acrylic as described with respect to FIGS. 4(*a*)–(*e*). The resulting design will be similar to that shown in FIGS. 4(*d*) and 4(*e*).

FIG. 5(*b*) is a side view of one embodiment of stencil 500, based upon the thick-layer form also shown in FIGS. 2(*a*)–*d*. As an alternative, the raised cut-out form of FIGS. 3(*a*)–(*c*) may be used.

FIG. 6 is a flow diagram illustrating the steps used in applying a three dimensional stencil according to the present invention. In step 602, the nail is roughened to improve bonding of the acrylic design. In step 604, a primer is applied to the nail, also to improve bonding. Steps 602 and/or 604 may be skipped if the nail design will be removed after a day or two.

In step 606 a stencil (200, 300, 400 or 500) is applied to nail 104. Acrylic 206 is poured or otherwise applied into the cut-out (202, 302, 402, or 502) in step 608. After the acrylic dries sufficiently, the stencil is removed in step 610. The acrylic may be painted if desired in step 612.

Arrow 614 indicates that steps 606–612 may be repeated with a new stencil or portion of a stencil, if a multilayer design is desired. See FIGS. 4(*a*) through 5(*b*).

What is claimed is:

1. A three dimensional stencil comprising:

a generally flat, flexible portion configured for contact with a portion of a fingernail or toenail; and a cut-out portion formed within the confines of the flexible portion, the cut-out portion configured to form a three dimensional design on the nail;

wherein the cut-out portion includes walls having a thickness of at least about 1 mm; and wherein the flexible portion forms an opening adjacent to the cut-out portion to allow a material for forming the three dimensional design to be poured into the cut-out portion and to adhere to the nail;

and wherein the stencil is constructed to leave the three dimensional design formed by the cut-out on the nail when the stencil is removed from the nail.

2. The three dimensional stencil of claim 1 wherein the flexible portion is itself of a thickness of at least about 1 mm, and the cut-out portion forms an opening in the flexible portion.

3. The three dimensional stencil of claim 1 wherein the cut-out portion comprises walls attached to and extending up from the flexible portion.

4. The three dimensional stencil of claim 3, further including tabs connecting the cut-out portion walls to the flexible portion.

5. The three dimensional stencil of claim 1, wherein the flexible portion is generally nail-shaped.

6. The three dimensional stencil of claim 5, wherein the flexible portion further comprises a sticky layer for sticking the flexible portion to the nail.

7. The three dimensional stencil of claim 1, wherein the flexible portion includes more than one cut-out portion.

8. The three dimensional stencil of claim 7, wherein the fexible portion comprises a sheet larger than a nail.

9. The three dimensional stencil of claim 1, wherein the walls have a thickness of between 1 mm and 3 mm.

10. A method of applying a three dimensional acrylic design to a fingernail or toenail comprising the steps of:

(a) Applying a flexible stencil having a cut-out with walls of at least about 1 mm to a nail;

(b) applying acrylic into the cutout to form a 3-d acrylic design; and (c) removing the stencil, leaving the 3-d design on the nail.

11. The method of claim 10, further comprising the step of:

roughening the nail prior to step (a).

12. The method of claim 11, further comprising the step of:

appying primer to the nail prior to step (a).

13. The method of claim 10, further comprising the steps of:

repeating steps (a) through (c) with different stencils or portions of a stencil to create a multilayer design.

14. The method of claim 10, further comprising the step of:

painting the 3-d acrylic design.

* * * * *